United States Patent [19]

Ogi et al.

[11] Patent Number: 4,868,102

[45] Date of Patent: Sep. 19, 1989

[54] DIRECT POSITIVE SILVER HALIDE LIGHT-SENSITIVE PHOTOGRAPHIC MATERIAL

[75] Inventors: Keiji Ogi; Atsushi Kamitakahara; Eiichi Sakamoto; Nariko Isozaki, all of Hino, Japan

[73] Assignee: Konica Corporation, Tokyo, Japan

[21] Appl. No.: 151,695

[22] Filed: Feb. 2, 1988

[30] Foreign Application Priority Data

Feb. 6, 1987 [JP] Japan ..... 62-26890

[51] Int. Cl.[4] ..... G03C 1/02; G03C 1/00

[52] U.S. Cl. ..... 430/598; 430/569; 430/940

[58] Field of Search ..... 430/598, 569, 940

[56] References Cited

U.S. PATENT DOCUMENTS

| | | | |
|---|---|---|---|
| 4,395,478 | 7/1983 | Hoyen | 430/598 |
| 4,481,285 | 11/1984 | Takagi et al. | 430/598 |
| 4,582,779 | 4/1986 | Kubota et al. | 430/598 |

*Primary Examiner*—Mukund J. Shah

*Attorney, Agent, or Firm*—Jordan B. Bierman

[57] ABSTRACT

A light-sensitive silver halide direct-positive photographic material which comprises a support and, provided thereon a light-sensitive direct-positive silver halide emulsion layer containing silver halide grains having an internal latent image and a core-shell structure comprising a core and at least one shell stratum either partly or entirely covering said core, the outermost stratum of said shell having been formed in the presence of a nitrogen-containing heterocyclic compound having a mercapto group therein.

7 Claims, No Drawings

DIRECT POSITIVE SILVER HALIDE LIGHT-SENSITIVE PHOTOGRAPHIC MATERIAL

FIELD OF THE INVENTION

The present invention relates to a direct positive silver halide light-sensitive photographic material, and more particularly to a direct positive light-sensitive photographic material having an internal latent image-type silver halide emulsion layer.

BACKGROUND OF THE INVENTION

Those conventionally known methods for obtaining direct positive images are classified into two types: One type is such that a silver halide emulsion in advance having fog specks is used, and the fog speck or latent image of the exposed area of the emulsion is destroyed by utilizing the solarization or herschel effect, and then developed to thereby obtain a positive image. And the other is such that an internal latent image-type silver halide emulsion not subjected to fogging treatment (generally, surface-fogging treatment) until the time of imagewise exposure is used, and the emulsion, after being imagewise exposed, is subjected to fogging treatment (core-making treatment), and then surface-developed, or the emulsion, after being imagewise exposed, is surface-developed while being subjected to fogging treatment, whereby a positive image is obtained.

The above-mentioned fogging treatment may be effected by having the emulsion overall exposed, chemically treated by using a fogging agent, developed by using a strong developer solution or thermally treated. The foregoing "internal latent image-type silver halide photographic emulsion" implies a silver halide photographic emulsion comprising silver halide crystal grains each having mainly thereinside a sensitivity speck so that a latent image is formed inside the grain as a result of being exposed to light.

Of the aforementioned two methods of forming positive images, the latter method, as compared to the former, generally results in a high sensitivity, so that the latter is suitable for use in the high sensitivity-requiring photography.

In this technological field, various techniques have hitherto been known: For example, those methods are known which are described in U.S. Pat. Nos. 2,592,250, 2,466,957, 2,497,875, 2,588,982, 3,761,266, 3,761,276 and 3,796,577, and British Pat. No. 1,151,363.

The mechanism of forming positive images are considered as follows, as described in, e.g., the Photographic Science and Engineering, Vol. 20, p.158 (1976): The photo electrons generated inside silver halide crystal grains by imagewise exposure are selectively captured into the inner part of the grain, whereby an internal latent image is formed. Since this internal latent image functions as an effective capture center for the electrons in the conduction band, in the case of exposed grains, the electrons that are injected during the course of the subsequent fogging-development are captured into the inner part of the grain to thereby intensify the latent image. In this instance, the latent image, since it all is in the inner part, is not developed. On the other hand, in the unexposed grains, at least a part of the injected electrons is captured onto the surface thereof, and these grains are developed by surface developement.

By using the foregoing techniques of the prior art, light-sensitive photographic materials for the formation of positive images can be produced. However, in order to make these light-sensitive photographic materials applicable to diverse photographic fields, they are required to be even more improved on the photographic characteristics thereof.

For example, as is disclosed in U.S. Pat. Nos. 3,761,267 and 3,206,313, by the chemical sensitization of the inner part of silver halide grains or by using a polyvalent metal ion-doped core/shell-type emulsion, a higher sensitivity can be obtained. Emulsions of this kind, however, have the shortcoming that they result in a low image density. Also, U.S. Pat. No. 3,761,276 discloses chemical ripening treatment to some extent of the surface of silver halide grains in order to remove the above shortcoming that the image density is low, but this treatment is disadvantageous in respect that it increases the minimum image density, significantly deteriorates the silver halide emulsion's stability in the preservation over a long period, and also deteriorates the emulsion's manufacturing stability.

On the other hand, the silver halide emulsion comprised principally of silver chloride disclosed in Japanese Patent Publication Open to Public Inspection (hereinafter referred to as Japanese Patent O.P.I. Publication) No. 32820/1972 produces a positive image of which the maximum density is relatively high, but the minimum density is not adequately low, so that the image is not clear.

Accordingly, in order to make a practical reality of a direct positive light-sensitive material comprising the above-mentioned internal latent image-type emulsion, the internal latent image-type emulsion is desired to be one having an adequately high maximum density and an adequately low minimum density, and being excellent in the preservability.

SUMMARY OF THE INVENTION

It is therefore an object of the present invention to provide a high-sensitivity direct positive silver halide light-sensitive photographic material having an adequately high maximum density and an adequately low minimum density and being excellent in the preservability by using a peculiar internal latent image-type silver halide emulsion.

The present invention relates to a light-sensitive silver halide direct-positive photographic material which comprises a support and, provided thereon a light-sensitive direct-positive silver halide emulsion layer containing silver halide grains having an internal latent image and a core-shell structure comprising a core and at least one shell stratum covering said core, the outermost stratum of said shell having been formed in the presence of a nitrogen-containing heterocyclic compound having a mercapto group therein. In other words, the above object of the present invention is accomplished by a light-sensitive direct-positive photographic material which has an emulsion layer comprising not-in-advance-fogged internal latent image-type silver halide grains and which, after being imagewise exposed, is capable of forming a direct positive image by being surface-developed after and/or while being subjected to fogging treatment, wherein the said internal latent image-type silver halide grain comprises a core and at least one shell stratum covering the core, and the outermost stratum of the shell is formed in the presence of a nitrogen-containing heterocyclic compound having a mercapto group.

DETAILED DESCRIPTION OF THE INVENTION

The present invention will then be detailed below:

The shell of the silver halide grain of this invention may either completely cover the surface of the core-forming silver halide grain or selectively cover a part of the surface.

The shell of the silver halide grain of this invention may be either a single-stratum shell or a multistratified shell comprised of two or more strata in the silver halide composition.

The multistratified shell comprises at least the outermost stratum and a layer adjacent thereto, and they may be of a construction comprising superposed strata different in the silver halide composition.

The strata of the multistratified shell may be of a construction wherein the silver halide composition continuously varies in the direction of the silver halide grain's diameter.

Of the above shell strata, the outermost stratum or the outermost surface of the shell is desirable to contain silver chloride. In this instance, the outermost stratum or surface, if it substantially contains silver chloride, may be of any silver halide composition such as silver chloride, silver chlorobromide, silver chloroiodide, silver chlorobromoiodide, or the like.

The shell of this invention is desirable to cover more than 50% of the surface of the core, and particularly desirable to completely cover the whole surface of the core.

The preparation of the silver halide shell to cover the core may be performed by the double jet method, in which an aqueous silver salt solution and an aqueous halide solution are simultaneously added to be mixed, or by the multiple jet method, in which an aqueous silver salt solution and two or more different aqueous halide solutions are independently added to be mixed.

As the double ject process, a method of mixing the solutions with its mixture's pAg or pH being controlled, the so-called controlled double jet method, may be used.

The pAg value at the time of preparing the shell, although it differs according to the silver halide composition, in the case of containing silver chloride, is not more than 8.5, and preferably not more than 8.0. The pH value may be arbitrarily controlled according to the acid method, neutral method, or ammoniacal method.

The core of the silver halide grain of this invention is desirable to be comprised principally of silver bromide, and may further contain silver chloride and/or silver iodobromide. The silver halide grain to form the core may be in any polyhedral form such as, e.g., hexahedral, octahedral or dodecahedral form or in a mixture of these forms, and may also be in a spherical, planar or indeterminate form. The average grain size and the grain size distribution of the silver halide grains constituting the core of this invention may be widely varied according to any desired photographic characteristics, but the grain size distribution width is preferred to be as much small as possible. That is, the silver halide grains constituting the core of this invention are desirable to be substantially monodisperse grains.

That the core is constituted by monodisperse silver halide grains herein implies that in the silver halide grains constituting the core, the weight of the silver halide grains which fall under the grain size range of the average grain size $\bar{r}\pm20\%$ accounts for not less than 60% of the weight of the whole silver halide grains, preferably not less than 70%, and particularly preferably not less than 80%.

In this specification, the average grain size $\bar{r}$ implies the grain size $r_i$ in the case where the product $n_i \times r_i^3$ of the frequency ni of the grains each having a grain size $r_i$ and $r_i^3$ becomes maximum (significant number of 3 figures, the units digit is rounded to the nearest whole number).

The 'grain size' herein, in the case of a spherical silver halide grain, is its diameter and, in the case of a non-spherical grain, is the diameter of a circular image equivalent in the area to its projection image.

The grain size may be obtained in the manner that, for example, the grain image is enlargedly projected in a magnifying power of from 10,000 to 50,000 times to be printed, and the printed grain image is actually measured with respect to its diameter or its projected area (the number of the grains to be measured is to be not less than 1,000 selected at random).

In this specification, the term "average grain size" is to be used in the meaning specified above.

The preparation of the above-mentioned monodisperse core emulsion may be made by using any of those double jet methods as described in, e.g., Japanese Patent Examined Publication No. 36890/1973, Japanese Patent O.P.I. Publication Nos. 48529/1979 and 65521/1979. In addition, the premix method described in Japanese Patent O.P.I. Publication No. 158220/1979 may also be used.

The core of the silver halide grain of this invention may be one chemically sensitized or doped with metallic ions, or one subjected to both treatments, or may also be one not subjected to both treatments at all.

As for the chemical sensitization, many methods are known which include methods for sulfur sensitization, gold sensitization, reduction sensitization, noble metal sensitization, and those in combination of these sensitizations. As the agent for use in the sulfur sensitization, thiosulfates, thioureas, thiazoles, rhodanines, and other equivalent compounds may be used. Such methods are described in, e.g., U.S. Pat. Nos. 1,574,944, 1,622,499, 2,410,689, 3,656,955 and the like.

The core of the silver halide grain to be used in this invention, as is described in U.S. Pat. Nos. 2,399,083, 2,597,856, 2,642,361, and the like, may be sensitized by a water-soluble gold compound, and may also be sensitized by using a reduction sensitizer. For such the method, reference can be made to the descriptions of, e.g., U.S. Pat. Nos. 2,487,850, 2,518,698, 2,983,610 and the like.

Further, a noble metallic compound such as Of. e.g., platinum, iridium, palladium, etc., may be used to make the noble metal sensitization of the grain. For such the method therefor reference can be made to the descriptions of, e.g., U.S. Pat. No. 2,448,060 and British Pat. No. 618,061.

The core of the silver halide grain of this invention may be doped with metallic ions. Doping the core with metallic ions may be made by adding a water-soluble salt of metallic ions to the core grain in a certain stage of the process of forming the same. Suitable examples of the metallic ion include those ions of iridium, lead, antimony, bismuth, gold, osmium, rhodium and the like. Any of these metallic ions may be used in a concentration of preferably from $1\times10^{-8}$ to $1\times10^{-4}$ mole per mole of silver.

The core of the silver halide grain of this invention may be one not subjected to the foregoing chemical sensitization treatment nor to the metallic ion-doping treatment. In this instance, in the course of covering the core grain with a shell, a sensitivity center is considered to be produced in the interface between the core and the shell due to the crystal strain or others, and for this matter, reference can be made to the descriptions of U.S. Pat. Nos. 3,935,014 and 3,957,488.

For the formation of the foregoing shell on the core, the double jet method or the premix method may be used. The formation may also be made by the Ostwald ripening of the core emulsion mixed with a fine-grained silver halide.

Subsequently, the mercapto group-having nigrogen-containing heterocyclic compound (hereinafter referred to as mercapto heterocylic compound) to be made present when forming the outermost stratum of the shell of the silver halide grain of this invention will be explained below:

The mercapto heterocyclic compound to be used in this invention is preferred to be a compound having the following Formula [I]:

Formula [I]

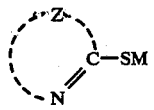

wherein M is a hydrogen atom, an alkali metallic atom, an ammonium group or a protective group for the mercapto group; Z is a group of nonmetallic atoms necessary to form the hetero-cyclic ring, provided that the heterocyclic ring may either have a substituent or be condensed.

The protective group represented by the M for the mercapto group is a group to be cleaved by an alkali to thereby form a mercapto group, and examples of the protective group include an acyl group, alkoxycarbonyl group, alkylsulfonyl group and the like.

The heterocyclic ring represented by the

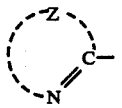

may have a carbon atom, nitrogen atom, oxygen atom, sulfur atom, selenium atom and the like as the ring constituting atoms, and is preferred to be a 5- to 6-member ring.

Examples of the heterocyclic compound include imidazole, benzimidazole, naphthoimidazole, thiazole, thiazoline, benzothiazole, naphthothiazole, oxazole, benzoxazole, naphthooxazole, selenazole, benzoselenazole, naphthoselenazole, triazole, benzotriazole, tetrazole, oxadiazole, thiadiazole, pyridine, pyrimidine, triazine, purine, azaindene, and the like.

Examples of the substituent, which these heterocyclic rings may have, include, e.g., halogens and hydroxy, amino, nitro, mercapto, carboxy and salts thereof; sulfo and salts thereof; and alkyl, alkoxy, aryl, aryloxy, alkylthio, arylthio, acylamino, sulfonamido, carbamoyl, sulfamoyl, and the like.

Of the compounds having Formula [I], those particularly suitably usable compounds are represented by the following Formulas [II]. [III] and [IV]:

Formula [II]

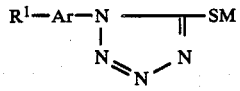

Formula [III]

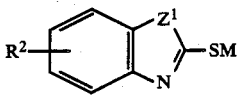

Formula [IV]

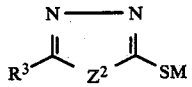

In Formulae [II] through IV, M is as defined in Formula [I].

In Formula [II], Ar is a phenyl group, a naphthyl group or a cycloalkyl group, and $R^1$ is a hydrogen atom or a substituent to Ar.

In Formula [III], $Z^1$ is an oxygen atom, a sulfur atom, a selenium atom or a —NH— group, and $R^2$ is a hydrogen atom or a substituent.

In Formula [IV], $Z^2$ is a hydrogen atom, a sulfur atom, a selenium atom or a

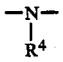

group (wherein $R^4$ is a hydrogen atom, an alkyl group, an alkenyl group, a cycloalkyl group, an aryl group, an aralkyl group, a $—COR^5$ group, a $—SO_2R^5$ group, a $—NHCOR^6$ or a $—NHSO_2R^6$ group, wherein $R^5$ is an alkyl group, an aryl group, an aralkyl group or an amino group, and $R^6$ is an alkyl group, a cycloalkyl group, an aryl group or an aralkyl group), and $R^3$ is a hydrogen atom, an alkyl group, an alkenyl group, a cycloalkyl group, an aryl group, an aralkyl group, a heterocyclic group or an amino group.

The following are typical examples of the compounds having Formula [I] (hereinafter referred to as the compound of this invention), but the present invention is not limited to and by the examples.

(1)

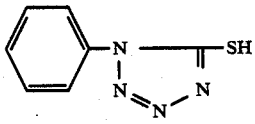

(2)

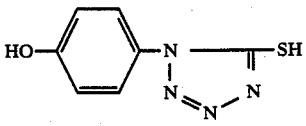

-continued
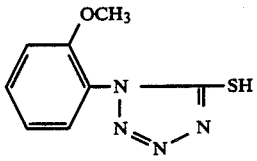
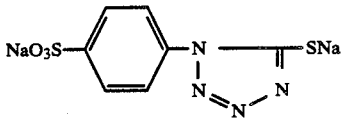
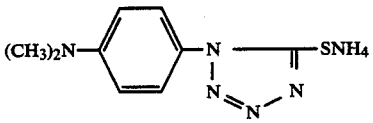
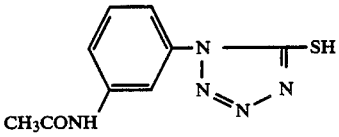
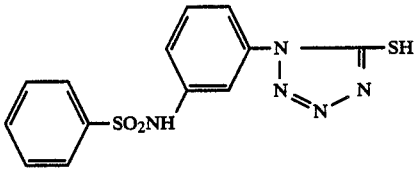
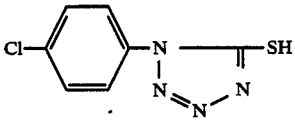
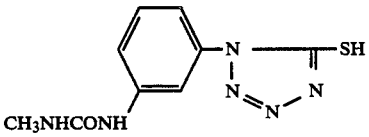
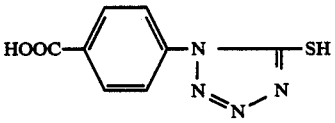
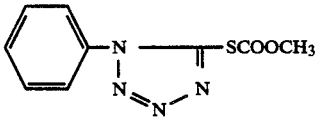
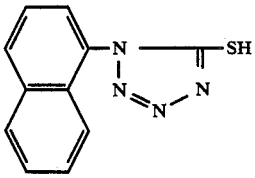
-continued
(3)
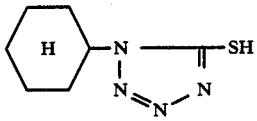
(4)
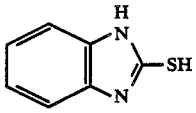
(5)
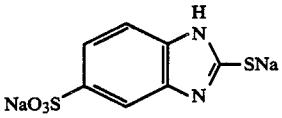
(6)
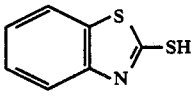
(7)
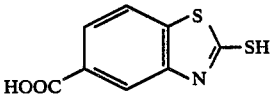
(8)
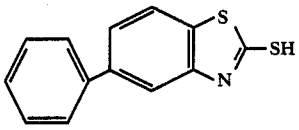
(9)
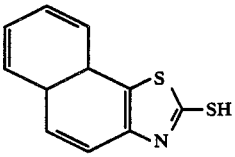
(10)
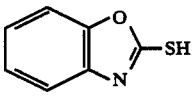
(11)
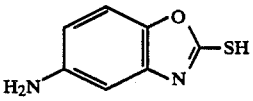
(12)
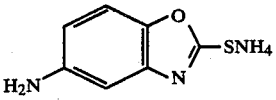
(13)
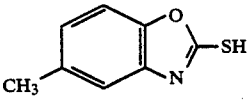
(14)
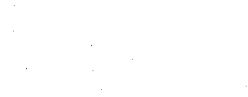
(15)
(16)
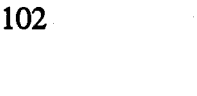
(17)
(18)
(19)
(20)
(21)
(22)
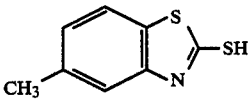
(23)
(24)
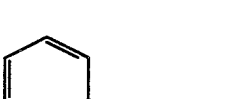

-continued (25)

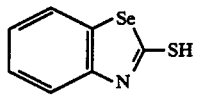

(26)

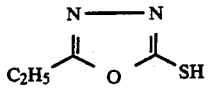

(27)

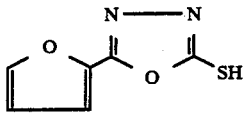

(28)

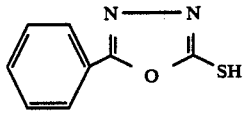

(29)

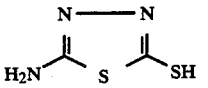

(30)

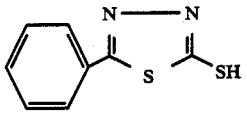

(31)

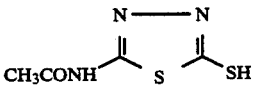

(32)

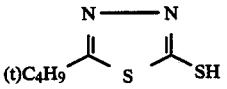

(33)

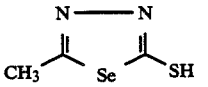

(34)

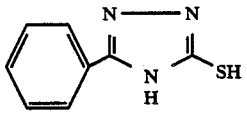

(35)

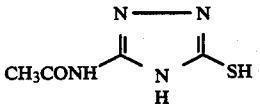

(36)

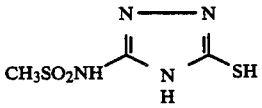

(37)

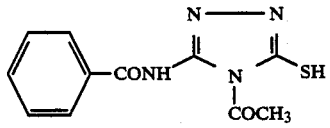

(38)

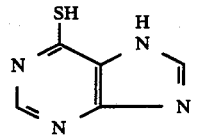

(39)

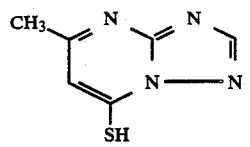

Any of the above compounds can be easily synthesized by those already known methods as described in, e.g., U.S. Pat. Nos. 2,403,927 and 3,376,310, Japanese Patent O.P.I. Publication No. 59463/1980, and Journal of the Chemical Society p.4237 (1952). Also, some of these compounds are commercially available.

The compound of this invention may be made in advance present at the time of forming the outermost stratum of the shell of the core/shell-type silver halide grain or may be added in the stage of forming the shell.

The adding amount of the compound is within the range of from $10^{-6}$ to $10^{-2}$ mole per mole of the silver halide produced. The addition of the compound may be performed in the form of a solution of the compound dissolved into an alcohol, acetone or the like.

The core/shell-type silver halide grain of this invention is desirable to have its surface not chemically sensitized or, even if sensitized, sensitized to only a slight extent.

Where the surface of the silver halide grain of this invention is chemically sensitized, the sensitization may be performed in similar manner to that of the foregoing core grain.

The silver halide grain of this invention may be in the regular crystalline form such as hexahedral, octahedral, dodecahedral or mixed polyhedral form (regular grains), or may be spherical, planar or indeterminate-form grains (irregular grains).

The silver halide grains of this invention are desirable to be of a grain size distribution the width of which is narrow even after the shell formation; i.e., desirable to be substantially monodisperse. Namely, the silver halide grains, even as a whole, should be substantially monodisperse as defined previously.

The monodisperse rate is preferably not less than 70%, and more preferably not less than 80%.

The core/shell ratio of the silver halide of this invention may be discretionally determined, but the shell portion is desirable to account for 10% to 100% of the whole silver halide of the silver halide grains.

As for the composition ratio of the silver halide grains Of this invention, the amount of silver chloride is desirable to account for 5% to 80% of the whole grains.

That the surface of the grains is not in advance fogged implies that when a test piece that has been obtained by coating an emulsion to be used in this invention on a transparent support so that the coated amount of Ag is 35 mg/cm$^2$, remaining unexposed, is developed in the following surface-developer solution A for 10 minutes at 20° C., the obtained density is 0.6, and does not exceed 0.4.

Surface-Developer Solution A

Metol: 2.5 g 1-ascorbic acid: 10.0 g
Sodium metaborate, tetrahydrated: 35.0 g
Potassium bromide: 1.0 g
Water to make 1 liter.

Also, the internal latent image-type silver halide emulsion according to this invention provides an adequate density when the above prepared test piece is exposed to light and then developed in the following internal-developer solution B.

Internal-Developer Solution B

Metol: 2.0 g
Anhydrous sodium sulfite: 90.0 g
Hydroquinone: 8.0 g
Sodium carbonate, monohydrated 52.5 g
Potassium bromide: 5.0 g
Potassium iodide: 0.5 g
Water to make 1 liter:

To explaine further in detail, when part of the foregoing test piece is exposed to light in light-intensity scale over a certain period of time up to 1 second and then developed in the internal-developer solution B for 10 minutes at 20° C., and the other part of the same test piece is exposed under the same condition and then developed in the surface-developer solution A for 10 minutes at 20° C., the former part of the test piece shows at least 5 times, preferably 10 times, as much high a maximum density as that of the latter.

The silver halide emulsion of this invention may be optically sensitized by those sensitizing dyes generally used. The combined use of those sensitizing dyes for use in the supersensitization of internal latent image-type silver halide emulsions, negative-type silver halide emulsions, etc. is also useful for the silver halide emulsion of this invention. For such sensitizing dyes, reference can be made to Research Disclosure No. 15162 and No. 17643.

The light-sensitive photographic material of this invention enables to easily obtain a direct positive image when imagewise exposed (photographed) in usual manner and then surface-developed. That is, the principal process of preparing a direct positive image comprises the step of producing a fog speck by the chemical reaction or optical reaction after imagewise exposure of a light-sensitive photographic material having the unfogged internal latent image-type silver halide emulsion layer of this invention; i.e., after being subjected to fogging treatment and/or while being subjected to fogging treatment, the light-sensitive photographic material is surface-developed. The fogging treatment herein is made by an overall exposure or using a compound to produce a fog speck, i.e., a fogging agent.

In this invention, the overall exposure is made in the manner that the imagewise exposed light-sensitive material, after being immersed in a developer solution or other aqueous solution or moistened, is overall exposed uniformly to light. The light source to be used herein may be of any type as long as it is a light which covers the wavelength regions to which the light-sensitive material is sensitive, and the overall exposure may be made by having the light-sensitive material exposed to a high-illuminance light such as an electronic flash light in a short time or to a weak light for a long period of time. The overall exposure time may be widely varied according to the light-sensitive photographic material used, the developing conditions, the type of the light source used, etc., so that a best positive image can be finally obtained.

As the fogging agent to be used in this invention, a large variety of compounds may be used. The fogging agent need only be present at the time of development; for example, the agent may be present in the non-support component layers of the light-sensitive photographic material (of them, the silver halide emulsion is preferred), or may be present in a developer solution or in a processing solution prior to the developer solution. The using amount of the fogging agent may be widely varied according to purposes, and the preferred using amount, when incorporated into the silver halide emulsion layer, is from 1 to 1,500 mg, and preferably from 10 to 1,000 mg. The preferred adding amount of the fogging agent, when incorporated into a processing solution such as a developer solution, is from 0.01 to 5 g/liter, and particularly preferably from 0.05 to 1 g/liter.

Examples of the fogging agent to be used in this invention include compounds having a group adsorptive to the silver halide surface, such as, for example, those hydrazines as described in U.S. Pat. Nos. 2,563,785 and 2,588,982, or those hydrazides or hydrazone compounds as described in U.S. Pat. No. 3,227,552; those heterocyclic quaternary nitrogen salt compounds as described in U.S. Pat. Nos. 3,615,615, 3,718,479, 3,719,494, 3,734,738 and 3,759,901; and those acylhydrazinophenylthioureas as described in U.S. Pat. No. 4,030,925. These fogging agents may also be used in combination. For example, the foregoing Research Disclosure No. 15162 describes the combined use of both nonadsorptive-type fogging agents and adsorptive-type fogging agents, and such the technique for the combination is effective also in this invention.

As the fogging agent of this invention, any of those of the adsorptive type or of the nonadsorptive type may be used, and both may also be used in combination.

Useful concrete examples of the fogging agent include hydrazide compounds such as phenylhydrazine hydrochloride, 1-formyl-2-(4-methylphenyl)hydrazine, 1-acetyl-2-phenylhydrazine, 1-methylsulfonyl-2-(3-phenylsulfonamidophenyl)hydrazine, etc.; N-substituted quaternary cycloammonium salts such as 3-(2-formylethyl)-2-methylbenzothiazolium bromide, 2-methyl-3-[[3-(phenylhydrazino)propyl]benzothiazolium bromide, etc.; 5-[1-ethylnaphtho(1,2-b)thiazoline-2-ylidene-ethylidene]-1-(2-phenylcarbazoyl)-methyl-3-(4-sulfamoylphenyl)-2-thiohydantoin. 5-(3-ethyl-2-benzothiazolinylidene)-3-[4-(2-formylhydrazino)phenyl]-rhodanine, 1-[4-(2-formylhydrazino)phenyl]-3-phenylthiourea, 1,3-bis[4-(2-formylhydrazino)phenyl]thiourea, and the like.

The light-sensitive photographic material having a silver halide emulsion layer of this invention, after being imagewise exposed, is subjected to surface-development after and/or while being overall exposed or in the presence of a fogging agent to thereby form a direct positive image. The surface-development implies that the light-sensitive material is developed in a developer solution substantially not containing any silver halide solvent.

As the developing agent usable in the surface-developer solution for use in developing the light-sensitive photographic material of this invention, those ordinary silver halide developing agents may be used which include, e.g., polyhydroxybenzenes such as hydroquinone, aminophenols, 3-pyrazolidones, ascorbic acid and derivatives thereof, reductones, phenylenediamines, etc., and mixtures of these compounds; to be more concrete, hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine. 4-amino-3-methyl-N-ethyl-N-(β-methanesulfonamidoethyl)aniline, 4-amino-3-methyl-N-ethyl-N-(β-hydroxyethyl)aniline, and the like. Any of these agents may be in advance incorporated into the emulsion layer so as to have the agent react with the silver halide while being immersed in a high-pH aqueous solution.

The developer solution to be used in this invention may further contain a specific fogging agent and development restrainer. Alternatively, these additives to the developer solution may be arbitrarily incorporated into the component layers of the light-sensitive photographic material.

The silver halide emulsion of this invention may also contain various photographic additives such as a wetting agent, layer's physical property-improving agent, coating aid and the like according to purposes.

Further, other photographic additives such as a gelatin plasticizer, surface active agent. ultraviolet absorbing agent, pH control agent, antioxidation agent, antistatic agent, viscosity increasing agent, granularity improving agent, dyes, mordant, brightening agent, developing speed control agent, matting agent, and the like may also be used.

The silver halide emulsion prepared as mentioned above may be coated, if necessary, through a subbing layer, antihalation layer, filter layer, etc., on a support, whereby the internal latent image-type silver halide light-sensitive photographic material of this invention is obtained.

The application of the light-sensitive photographic material of this invention to color photography is useful. In this instance, the silver halide emulsion is desirable to contain cyan, magenta and yellow dye image-forming couplers. As the couplers, those for common use may be used. For such the couplers, reference can be made to Research Disclosure No. 17643 (December 1978) and No. 18717 (November 1979).

Incorporation of a ultraviolet-absorbing agent into the light-sensitive photographic material of this invention is useful for preventing the resulting dye image from being discolored by short-wavelength active rays.

Examples of the support of the light-sensitive photographic material of this invention include at-need-subbed polyethylene terephthalate film, polycarbonate film, polystyrene film, polypropylene film, cellulose acetate film, glass, baryta paper, polyethylene-laminated paper, and the like.

In the silver halide emulsion layer of this invention, as the protective colloide or binder thereof, an appropriate gelatin derivative may be used according to purposes in addition to gelatin. Examples of the appropriate gelatin derivative include, e.g., acylated gelatin, guanidylated gelatin, carbamylated gelatin, cyanoethanolated gelatin, esterified gelatin, and the like.

Also, in this invention, other hydrophilic binder materials may be incorporated according to purposes, which include polyvinyl alcohol, polyvinyl pyrolidone, hydrolyzed polyvinyl acetate, and the like, which binder materials may be added according to purposes to the emulsion layer or other photographic component layers of the light-sensitive photographic material, such as an intermediate layer, protective layer, filter layer, backing layer, and the like. Further, the above hydrophilic binder may, if necessary, contain an appropriate plasticizer, lubricant, and the like, according to purposes.

The component layers of the light-sensitive photographic material of this invention may be hardened by an arbitrary hardening agent, examples of which include chromium salts, zirconium salts, and aldehyde-type, halotriazine-typ, polyepoxy compound-type, ethyleneimine-type, vinylsulfon-type and acryloyl-type hardening agnets such as aldehyde, mucohalogenic acid and the like.

The light-sensitive photographic material of this invention has on the support thereof at least one light-sensitive emulsion layer containing internal latent image-type silver halide grains and, in addition, may have various photographic component layers such as a filter layer, intermediate layer, protective layer, subbing layer, backing layer, antihalation layer and the like.

In the case where the light-sensitive photographic material of this invention is for full color use, on the support thereof are provided at least one red-sensitive silver halide emulsion layer, at least one green-sensitive silver halide emulsion layer and at least one blue-sensitive silver halide emulsion layer. In this instance, at least any one of these light-sensitive silver halide emulsion layers need only contain the internal latent image-type silver halide grains of this invention, but it is preferred that all these light-sensitive silver halide emulsion layers contain the internal latent image-type silver halide grains of this invention. These light-sensitive silver halide emulsion layers each may be comprised of two or more separate sub-layers identical in the color sensitivity but different in the speed. In this instance, at least one layer comprising sub-layers different in the speed but identical in the color sensitivity need only contain the internal latent image-type silver halide grains of this invention, but it is preferred that all the layers contain the internal latent image-type silver halide grains of this invention.

The light-sensitive photographic material of this invention may be effectively applied to various uses such as black-and-white general use, radiographic use, color photographic use, false color use, graphic arts use, infrared photographic use, micrographic use, silver dye bleach process use, and the like, and besides, may also be applied to the colloid transfer process, silver salt diffusion transfer process, and those color image transfer processes, color diffusion transfer processes, etc., as described in Rogers, U.S. Pat. Nos. 3,087,817, 3,185,567 and 2,983,606; Weyerts et al, 3,253,915; Whitmore et al, 3,227,550; Barr et al, 3,227,551; Whitmore et al, 3,227,552, and Land et al, 3,415,644 and 3,415,645.

EXAMPLES

The present invention will be illustrated further in detail by the following examples, but the embodiment of this invention is not limited to and by the examples.

EXAMPLE 1

Equivalent molar amounts of both an aqueous silver nitrate solution and an aqueous potassium bromide solution were added to be mixed at 60° C. with the pAg thereof being kept at 7 by the controlled double-jet process to thereby prepare a silver bromide emulsion A. containing cubic silver bromide grains of which the average grain size after desalting is 0.3 μm.

This emulsion A was used as core grains, and to this were further added simultaneously both an aqueous silver nitrate solution and an aqueous sodium chloride solution at 60° C. with the pAg thereof being kept at 6 by the double-jet process to thereby obtain a core/shell-type emulsion B containing cubic core/shell grains having an average grain size of 0.45 μm. The thus obtained emulsion was a monodisperse emulsion having a narrow grain-size distribution.

Also, the emulsion A was used as core grains to obtain core/shell-type emulsions C, D, E and F in the same manner except that, before the formation of the shell, the compounds of this invention as given in Table 1 were added separately to the core emulsion (emulsion A)(the adding amount was based on the core emulsion).

Each of the above-obtained emulsions B through F, after adding usual coating aid and hardening agent thereto, was coated on a cellulose triacetate support so that the coated silver amount was 35 mg/100 cms, nd then dried, whereby samples were prepared.

These samples were then subjected to the following treatment: Each sample was allowed to stand for three days under the condition of 20° C./55% RH (RH stands for relative humidity)(Condition-1), and also allowed to stand for three days under the condition of 50° C./80% RH (Condition-2). The obtained samples each was exposed through an optical wedge to light by using a sensitometer, and then developed for four minutes at 20° C. in a developer solution of the following composition, and subsequently fixed, washed and then dried.

Phenidone: 0.4 g
Anhydrous sodium sulfite: 75.0 g
Hydroquinone: 10.0 g
Sodium carbonate, monohydrated: 40.0 g
Potassium bromide: 4.0 g
5-Methylbenzotriazole: 10.0 mg
1-Acetyl-2-phenylhydrazine (fogging agent): 0.1 g
Water to make 1 liter:
(Sodium hydroxide was used to adjust the pH to 12.5)

The obtained positive image was measured with respect to results are given in Table 1.

TABLE 1

| Sample No. | EM | Added compound | Added quantity [mg/mol Ag] | Condition-1 Maximum density | Condition-1 Minimum density | Condition-2 Maximum density | Condition-2 Minimum density | Remarks |
|---|---|---|---|---|---|---|---|---|
| 1 | B | None | 0 | 0.87 | 0.34 | 0.71 | 0.49 | Comparative |
| 2 | C | Cpd. (3) | 30 | 0.83 | 0.13 | 0.80 | 0.14 | Invention |
| 3 | D | Cpd. (6) | 30 | 0.84 | 0.13 | 0.81 | 0.14 | Invention |
| 4 | E | Cpd. (16) | 30 | 0.85 | 0.17 | 0.79 | 0.19 | Invention |
| 5 | F | Cpd. (37) | 30 | 0.82 | 0.16 | 0.78 | 0.17 | Invention |

As is apparent from the results given in Table 1, satisfactory positive images can be obtained from the emulsions of this invention. Namely, it is understood that in each sample of this invention, the maximum density is adequately high, the minimum density is adequately low, and the preservability under the condition of a high temperature/high humidity is significantly improved.

EXAMPLE 2

Equivalent molar amounts of an aqueous silver nitrate solution and an aqueous potassium bromide solution were simultaneously added to an aqueous gelatin solution kept at 60° C. with the pAg thereof being kept constant (8.7). After completion of the addition, the emulsion was washed to be desalted to thereby obtain a silver bromide emulsion containing tetradecahedral silver bromide grains having an average grain size of 0.4 μm. To this emulsion were added 3.0 mg per mole of silver of sodium thiosulfate, and the emulsion was chemically ripened at 60° C. for 60 minutes, whereby an emulsion G was obtained.

This emulsion was used as core grains to prepare the following core/shell-type emulsions H and I.

Emulsion H: The emulsion G was used as core grains, and to this were added simultaneously both an aqueous silver nitrate solution and an aqueous potassium bromide solution at 60° C. with the pAg thereof being kept at 7 to thereby grow the grains up to 0.5 μm in grain size, and subsequently to this were further added simultaneously both an aqueous silver nitrate solution and an aqueous sodium chloride solution with the pAg thereof being kept at 7 to thereby obtain a core/shell-type emulsion containing cubic core/shell grains having an average grain size of 0.5 μm.

Emulsion I: A core/shell-type emulsion was prepared in the same manner as in the emulsion H: That is, the emulsion was prepared in quite the same manner as in the emulsion H except that, prior to the addition of both an aqueous silver nitrate solution and an aqueous sodium chloride solution, 50 mg per mole of silver of Compound (6) of this invention were added.

To each of the above-obtained emulsions H and I was added a liquid prepared by dispersing into an aqueous gelatin solution a solvent solution of a sensitizing dye 5,5'-diphenyl-9-ethyl-3,3'-disulfopropyloxacarbocyanine sodium salt and a magenta coupler 1-(2,4,6-trichlorophenyl)-3-(2-chloro-5-octadecylsuccinimidoanilino)-5-pyrazolone, and was further added a hardening agent, and the obtained emulsions each was coated on a resin-coated paper support so that the coated amount of silver was 4 mg/100 cm$^2$, and then dried.

Each of these samples was exposed through an wedge with an yellow filter, and then developed at 38° C. for three minutes in a developer solution of the following composition:

4-Amino-3-methyl-N-ethyl-N-(β-methanesulfonamidoethyl)aniline sulfate: 5.0 g
Anhydrous sodium sulfite: 2.0 g
Sodium carbonate, monohydrated: 15.0 g
Potassium bromide: 1.0 g
Benzyl alcohol: 10.0 ml
Water to make 1 liter: (Potassium hydroxide was used to adjust the pH to 10.2)

Provided, however, that the entire area of the sample was uniformly exposed to white light at an illuminance of 1 lux for 20 seconds following 20 seconds after the commencement of the development. After that, the sample was subjected to bleach-fix, washing and then drying in usual manner.

Each of the obtained samples was measured with respect to the magenta positive image formed thereon. The results are given in Table-2.

TABLE 2

| EM No. | Emulsion | Maximum density | Minimum density | Remarks |
|---|---|---|---|---|
| 6 | H | 1.41 | 0.19 | Comparative |
| 7 | I | 1.37 | 0.06 | Invention |

From the results given in Table 2, it is understood that the emulsion, in which the shell is formed in the presence of the compound of this invention, has a significantly low maximum density, and therefore a satisfactory positive image can be obtained.

EXAMPLE 3

Equivalent molar amounts of both an aqueous ammoniacal silver nitrate solution and an aqueous potassium bromide solution were added simultaneously at 40° C., spending about 15 minutes, by the double-jet process with the pH and pAg thereof being kept at 9.0 and 8.3, respectively, whereby a silver bromide emulsion J containing cubic silver bromide grains having an average grain size of 0.5 μm was obtained.

The emulsion J was used as core grains to prepare the following core/shell-type emulsions K and L.

Emulsion K: To the emulsion J with the pAg thereof adjusted to 7.0 were added simultaneously both an aqueous silver nitrate solution and an aqueous potassium bromide/potassium chloride mixture solution (molar ratio: KBr:KCl=1:1) over a period of about 10 minutes with the pH and pAg thereof being kept at 8.0 and 7.0, respectively, whereby a core/shell-type emulsion containing cubic core/shell grains having an average grain size of 0.6 μm was obtained.

Emulsion L: An emulsion L was obtained in the same manner as in the emulsion K. That is, the emulsion was prepared in quite the same manner as in the emulsion K except that 30 mg per mole of silver of Compound (3) of this invention were added prior to the addition of both the ammoniacal silver nitrate solution and the potassium bromide/potassium chloride mixture solution.

Subsequently, to the emulsion K, as is described in Japanese Patent Examined Publication No. 12709/1970, Compound (3) of this invention was added in an amount of 30 mg per mole of silver to thereby prepare an emulsion M, and in an amount of 300 mg per mole of silver to thereby prepare an emulsion N.

To each of the above-obtained emulsions K through N were added an sensitizing dye 5,5'-dichloro-3,3'-di-(3-sulfobutyl)-9-ethylthiacarbocyanine sodium salt and a cyan coupler 2,4-dichloro-3-methyl-6-[α-(2,4-di-tert-acylphenoxy)butylamido]phenol, and further added a hardening agent, and the finally obtained emulsion was coated on a resin-coated paper support so that the coated amount of silver was 5 mg/100 cm$^2$.

These samples were allowed to stand under quite the same conditions (Condition-1 and Condition-2) as in the foreging Example 1, and further exposed and developed in quite the same manner as in Example 2. The results of the obtained cyan positive images are as given in Table 3.

TABLE 3

| Sample No. | EM | Condition-1 Maximum density | Condition-1 Minimum density | Condition-2 Maximum density | Condition-2 Minimum density | Remarks |
|---|---|---|---|---|---|---|
| 8 | K | 1.64 | 0.12 | 1.78 | 0.27 | Comparative-1 |
| 9 | L | 1.60 | 0.05 | 1.63 | 0.06 | Invention |
| 10 | M | 1.61 | 0.11 | 1.71 | 0.23 | Comparative-2 |
| 11 | N | 1.07 | 0.06 | 1.24 | 0.09 | Comparative-3 |

As is apparent from the results shown in Table 3, in Sample No. 10, wherein the compound of this invention was merely added to the emulsion, the minimum density cannot be adequately small, while in Sample No. 11, wherein the compound of this invention was added in a much larger amount than in Sample No. 10, although the minimum density can be restrained, the maximum density is significantly lowered.

On the other hand, where the compound of this invention was added in accordance with the method of this invention (Sample 9), a satisfactory positive image can be obtained, which is stably preservable over a long period even under a high temperature/high humidity condition.

According to the direct positive light-sensitive photographic material of this invention, a direct positive image of which the maximum density is adequately high and the minimum density is adequately low can be obtained. Further, the light-sensitive material of this invention is one significantly improved on the preservability under a high temperature/high humidity condition.

What is claimed is:

1. A light-sensitive silver halide direct-positive photographic material which comprises a support and, provided thereon a light-sensitive direct-positive silver halide emulsion layer containing silver halide grains having an internal latent image and a core-shell structure comprising a core and at least one shell stratum either partly or entirely covering said core, the outermost stratum of said shell having been formed in the presence of a nitrogen-containing heterocyclic compound having a mercapto group therein.

2. The light-sensitive silver halide direct-positive photographic material of claim wherein said nitrogen-containing heterocyclic compound having a mercapto group therein is represented by formula [I], [I]

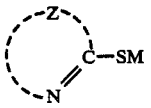

wherein M is selected from the group consisting of a hydrogen atom, an alkali metallic atom, an ammonium group or a protective group for the mercapto group, Z is a group of non-metallic atoms necessary to form a heterocyclic ring provided that said heterocyclic ring may either have a substituent or be condensed.

3. The light-sensitive silver halide direct-positive photographic material of claim 2, wherein said protecting group is selected from the group consisting of an acyl group, alkoxycarbonyl group, alkylsulfonyl group.

4. The light-sensitive silver halide direct-positive photographic material of claim 2, wherein said heterocyclic ring is a 5-member or 6-member ring.

5. The light-sensitive silver halide direct-positive photographic material of claim 2, wherein said heterocyclic ring is selected from the group consisting of an imidazole, a benzimidazole, a naphthoimidazole, a thiazole, a thiazoline, a benzothiazole, a naphthothiazole, an oxazole, a benzoxazole, a naphthooxazole, a selenazole, a benzoselenazole, a naphthoselenazole, triazole, a benzotriazole, a tetrazole, an oxadiazole, a thiadiazole, a pyridine, a pyrimidine, a triazine, a purine and an azaindene.

6. The light-sensitive silver halide direct-positive photographic material of claim 2, wherein said outermost stratum contains silver chloride.

7. The light-sensitive silver halide direct-positive photographic material of claim 6, wherein said outermost stratum contains silver halide selected from the group consisting of silver chloride, silver chlorobromide, silver chloroiodide, silver chlorobromoiodide, silver chloride.

* * * * *